US005108261A

United States Patent [19]

Ress, Jr. et al.

[11] Patent Number: 5,108,261

[45] Date of Patent: Apr. 28, 1992

[54] COMPRESSOR DISK ASSEMBLY

[75] Inventors: Robert A. Ress, Jr., Carmel, Ind.; Craig A. Blazakis, West Palm Beach, Fla.

[73] Assignee: United Technologies Corporation, Hartford, Conn.

[21] Appl. No.: 728,510

[22] Filed: Jul. 11, 1991

[51] Int. Cl.[5] ..... F01D 5/16

[52] U.S. Cl. ..... 416/190; 416/193 A; 416/500

[58] Field of Search ..... 416/193 A, 193 R, 223 A, 416/223 R, 248, 190, 500

[56] References Cited

U.S. PATENT DOCUMENTS

| | | | |
|---|---|---|---|
| 3,871,791 | 3/1975 | Guy et al. | 416/193 |
| 4,019,832 | 4/1977 | Salemme et al. | 416/248 |
| 4,062,638 | 12/1977 | Hall, Jr. | 416/193 A |
| 4,355,957 | 10/1982 | Sifford et al. | 416/190 |
| 4,505,642 | 3/1985 | Hill | 416/500 |
| 4,568,247 | 2/1986 | Jones et al. | 416/190 |
| 4,595,340 | 6/1986 | Klassen et al. | 416/193 A |
| 4,784,572 | 11/1988 | Novotny et al. | 416/213 |
| 4,784,573 | 11/1988 | Ress, Jr. | 416/213 R |
| 4,872,812 | 10/1989 | Hendley et al. | 416/190 |
| 4,917,574 | 4/1990 | Dodd et al. | 416/193 A |

*Primary Examiner*—John T. Kwon
*Attorney, Agent, or Firm*—Edward L. Kochey, Jr.

[57] ABSTRACT

A lightweight, integrally bladed rotor has airfoils (18) and a full hoop blade platform (26), a support ring (28) is inside and spaced from the platform, with radial webs (30) extending from the support ring to the platform. Each web is a radial extension (32) of an airfoil. A radially extending shear plate (36) is secured to the platform and the ring.

6 Claims, 4 Drawing Sheets

COMPRESSOR DISK ASSEMBLY

The Government has rights in this invention pursuant to a contract awarded by the Department of the Air Force.

1. Technical Field

The invention relates to high speed compressors and in particular to integrally bladed rotors therefor.

2. Background of the Invention

Compressor rotors for gas turbine engines are formed of one or more disks, each disk having a plurality of airfoils attached. At high speed high centrifugal forces are created. Any portion of the disk which is continuous around a hoop is considered live load since it contributes to resisting the centrifugal force. Any other structure not forming this hoop is considered dead load which increases the forces but does not directly contribute to the strength. As a general rule designs have avoided dead load at all locations inboard of the airfoils.

FIG. 1 shows a conventional compressor rotor 10 within a row of blading 12. It uses full hoop disk material 14 from the bore, through the web and out to the flow path.

FIG. 2 shows a prior art low hub/tip ratio compressor 16 application with airfoils 18, and platform 20 forming a high flow path convergence angle. In this structure the web usually disappears as the disk degenerates to a ring disk 22. While such a ring disk can adequately carry the airfoil load, it is generally heavier than necessary since it contains a large amount of underutilized material near the rim.

SUMMARY OF THE INVENTION

Reduced stage weight over the prior art designs is achieved by removal of the underutilized material near the rim.

The integrally bladed compressor disk assembly has a plurality of circumferentially spaced airfoils and a full hoop blade platform located at the base of the airfoils. A support ring is located concentrically inside and spaced from the blade platform. A plurality of webs extend from the support ring to the blade platform, and are radially aligned as an extension of the airfoils. A radially extending shear plate is located preferably at the upstream end of the support ring and blade platform and sealingly closes the space between the two. A plurality of stiffening rings pass circumferentially as an integral part of the blade platform to resist local bending.

DESCRIPTION OF THE PREFERRED EMBODIMENT

Figure 3:
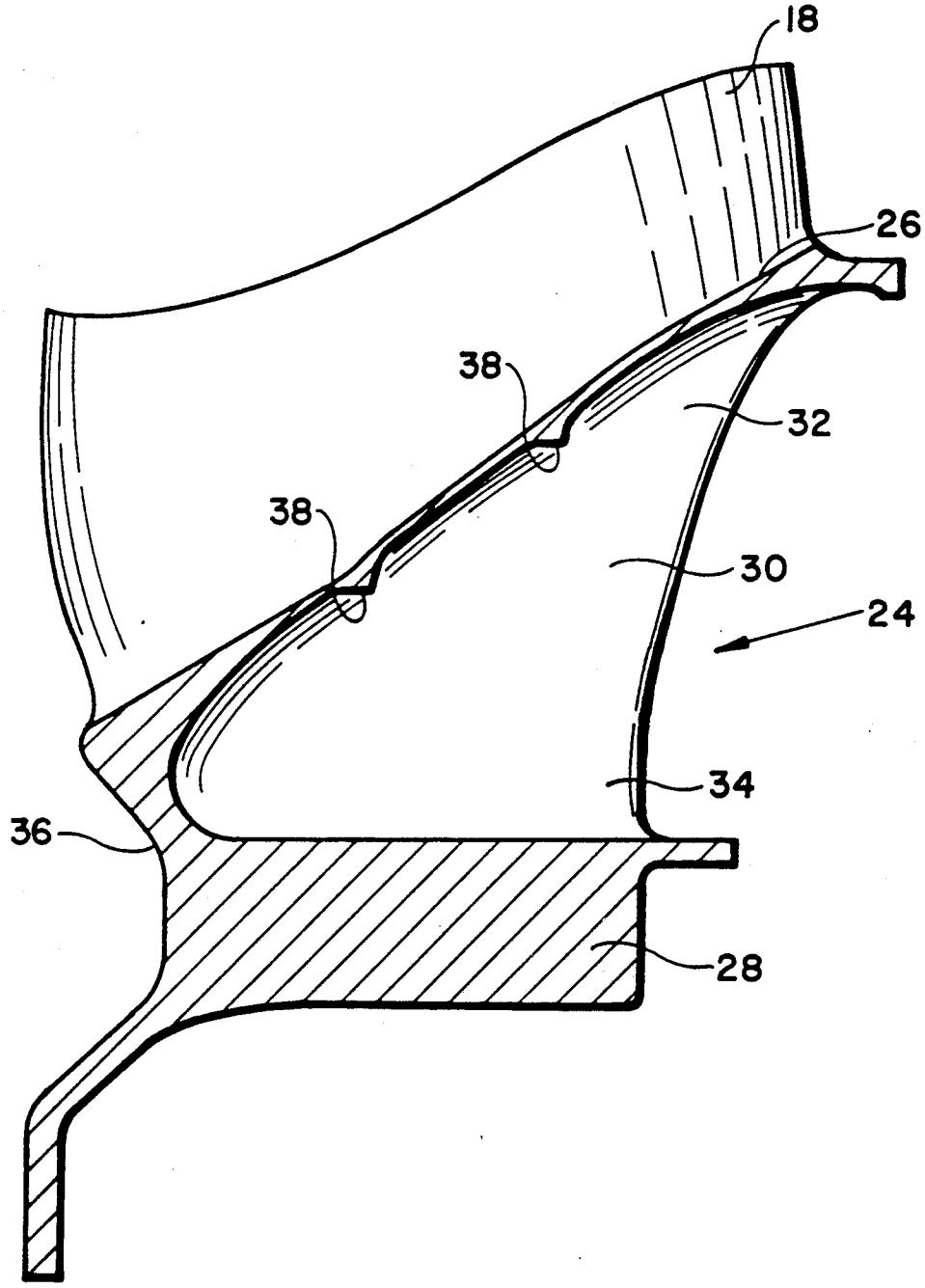
FIG. 3 is a section through one compressor stage.
Figure 4:
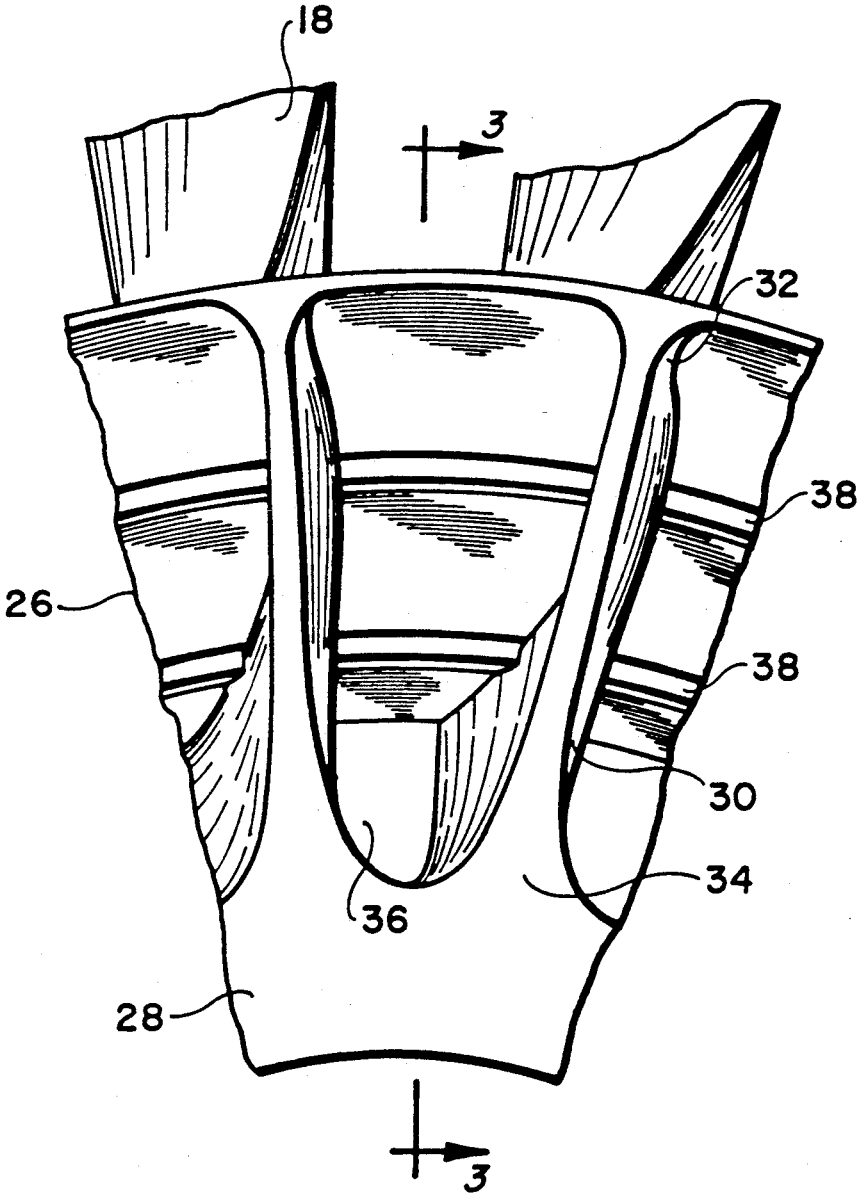
FIG. 4 is an end view of FIG. 3.

Referring to FIGS. 3 and 4, the compressor disk assembly 24 carries a plurality of circumferentially spaced airfoils 18. A full hoop blade platform 26 is located at the base of the airfoils. Support ring 28 is concentrically inside and spaced from the blade platform.

Each of a plurality of webs 30 extends from the blade platform to the support ring. At the outer diameter portion of the webs 32 where they join the blade platform they are established as radial continuations of the airfoils. At the inner diameter portion 34 these webs have been faired to a straight line in substantially the axial direction. The linearization of these webs reduces the moment of inertia and accordingly reduces the bending stress at the stress concentration area 34 where they are connected to the ring 28.

Shear plate 36 is integral with the ring and blade platform and located at the leading edge. It is impervious and seals against air recirculation.

A plurality of stiffening rings 38 are integral with the inside diameter of the platform and function to stiffen the platform against bending between the airfoil locations.

Figure 5:
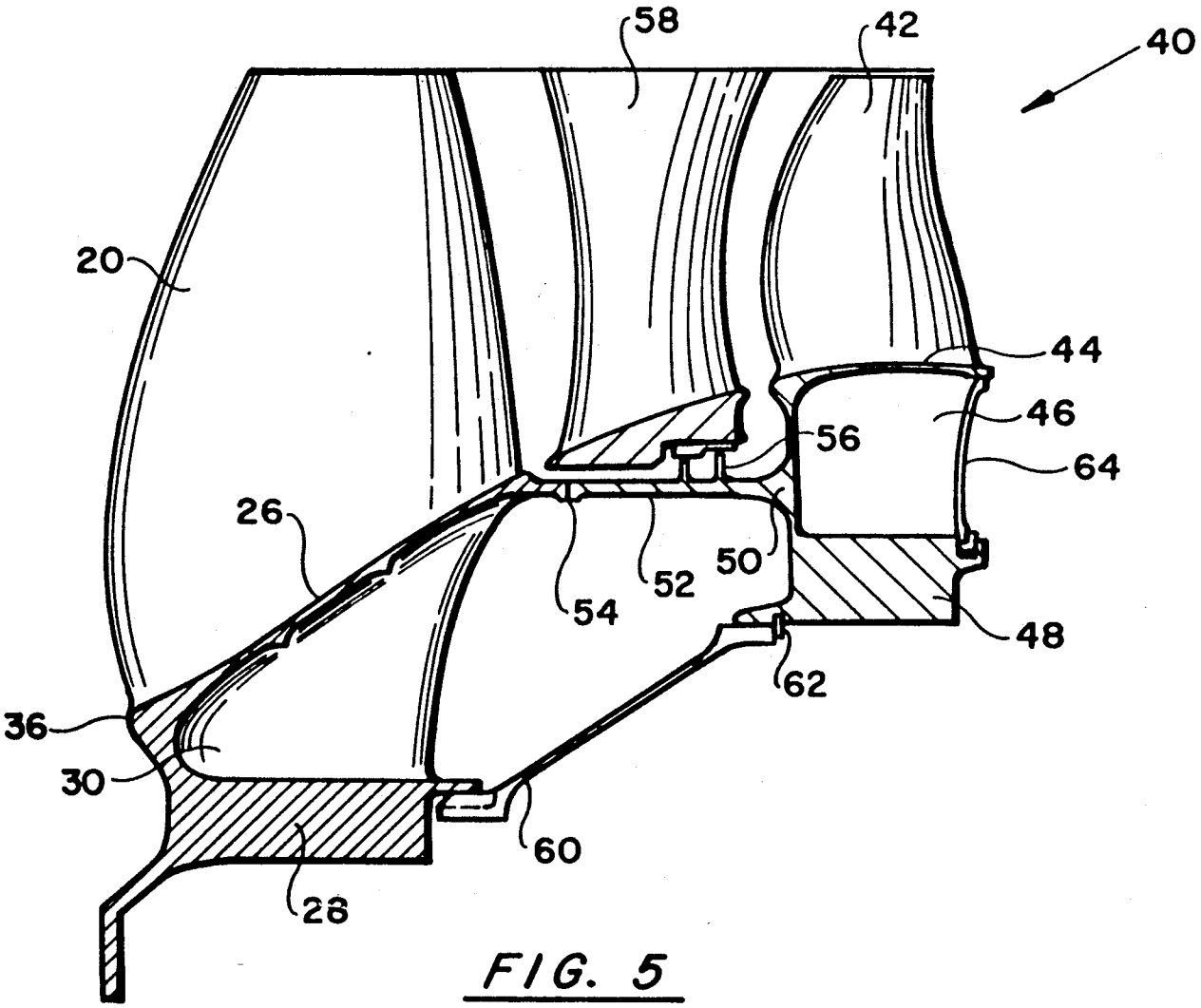
FIG. 5 is a section showing two compressor stages.

FIG. 5 illustrates an application of the invention to a two stage compressor. The second compressor stage 40 has a plurality of airfoils 42 circumferentially spaced on the full hoop of airfoil platform 44. Webs 46 extend to support ring 48.

The shear plate 50 has an integral arm 52 extending toward the first stage where it is welded at location 54 to an extension of the first stage blade platform 26. This extension carries seal rings 56 operative to restrict air bypass around stationary vanes 58.

Bore tube 60 runs from the aft end of first stage ring 28 to the forward end of the second stage ring 48. This tube is radially snapped at each end is axially retained by a snap ring 62. Grooves are located to vent the cavity. The closed cavity thus formed prevents windage losses caused by the first stage webs.

A full hoop cover 64 is located at the aft face of second stage webs 46, preventing windage losses caused by the second stage webs.

Figure 2:
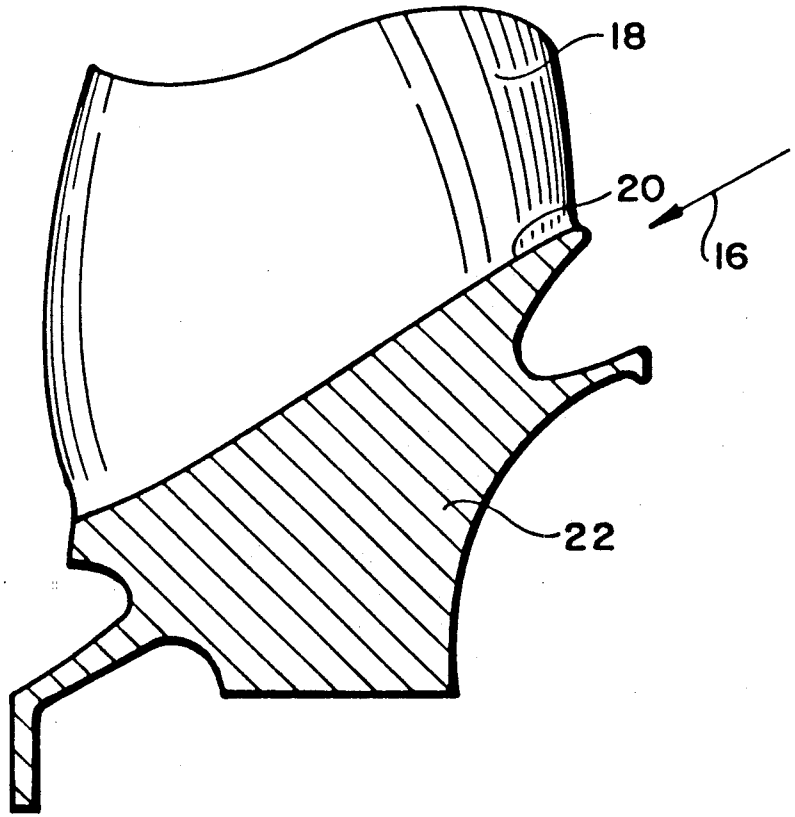
FIG. 2 (PRIOR ART)
FIG. 2 is a prior art disk for a high convergent angle.
Figure 1:
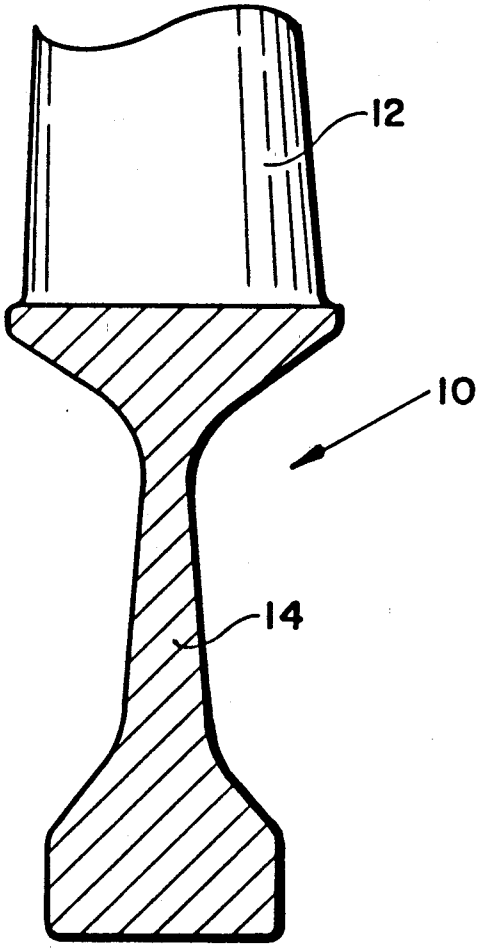
FIG. 1 (PRIOR ART)
FIG. 1 is a prior art compressor disk.

A conventional disk substantially as shown in FIG. 2 has been evaluated having a disk weight of 140 pounds and an airfoil weight of 102 pounds for a total weight of 244 pounds. In this study the bore tangential stress is 75000 psi with an average tangential stress of 45000 psi.

Although conventional wisdom dictates using full hoop loading below the platform, applicant has removed a portion of such material which was underutilized. The lightweight disk has a ring weight of 56 pounds with a platform weight of 17 pounds. The webs are 34 pounds and the airfoils are 102 pounds for a total of 210 pounds, thus being 32 pounds less than the conventional disk. The bore tangential stress is again 75000 psi with the average tangential stress increasing to 49000 psi.

Therefore, while maintaining the same maximum stress, a significant weight reduction has been achieved.

We claim:

1. An integrally bladed compressor disk assembly comprising:

a plurality of circumferentially spaced airfoils;

a full hoop blade platform located at the base of said airfoils;

a support ring concentrically inside and spaced from said blade platform;

a plurality of webs, each extending from said blade platform to said support ring and comprising a radial extension of an airfoil; and a radially extending shear plate secured to said blade platform and said support ring.

2. An integrally bladed compressor disk assembly as in claim 1 further comprising:

said shear plate being impervious and sealingly secured to both said platform and said ring.

3. An integrally bladed compressor disk assembly as in claim 2 further comprising:

said shear plate integral with said platform and said ring.

4. An integrally bladed compressor disk assembly as in claim 3 further comprising:

said shear blade located at the upstream edge of said platform and said ring.

5. An integrally bladed compressor disk assembly as in claim 1 further comprising:

a plurality of circumferential stiffening rings integral with the inside diameter of said platform.

6. An integrally bladed compressor disk assembly as in claim 1 further comprising:

said webs comprising a radial extension of said airfoils only at an outer diameter, and fairing to linear substantially axial webs adjacent said support ring.

* * * * *